United States Patent [19]

Bloess

[11] 4,430,202

[45] Feb. 7, 1984

[54] DISTILLATE OIL MOISTURE DEHAZING PROCESS

[76] Inventor: J. J. Bloess, 313 Shenandoah Rd. East, Mobile, Ala. 36608

[21] Appl. No.: 355,145

[22] Filed: Mar. 5, 1982

[51] Int. Cl.[3] ..... C10G 33/00

[52] U.S. Cl. ..... 208/187; 208/188

[58] Field of Search ..... 208/187, 188, 349

[56] References Cited

U.S. PATENT DOCUMENTS

| | | | |
|---|---|---|---|
| 2,853,157 | 9/1958 | Harper | 208/187 |
| 3,215,619 | 11/1965 | Brooke | 208/188 |
| 3,294,676 | 12/1966 | Brunner | 208/187 |
| 3,445,399 | 5/1969 | Jander | 208/187 |

*Primary Examiner*—Delbert E. Gantz
*Assistant Examiner*—Anthony McFarlane
*Attorney, Agent, or Firm*—Cushman, Darby & Cushman

[57] ABSTRACT

A process for de-watering distillate fuel oil to render the final product clear and bright includes the steps of passing the fuel oil from the stripping step and after process heat recovery and prior to sending to storage to a first heat exchanger and then a separate second heat exchange system to sequentially reduce the temperature of the moisture laden oil before introducing the oil to a sand coalescer vessel where removal of the moisture takes place; the de-watered oil is then passed through the first heat exchanger to raise its temperature a small amount before being passed to a storage tank.

8 Claims, 2 Drawing Figures

DISTILLATE OIL MOISTURE DEHAZING PROCESS

BACKGROUND AND BRIEF DESCRIPTION OF THE INVENTION

The present invention relates to a process for removing water moisture haze from hydrocarbon distillate oils subsequent to the steam stripping and normal process cooling of the oils.

In the refining of petroleum distillate fuel oils, the final steam stripping process produces a highly water saturated oil which, as the oil is cooled for storage, takes on a hazy or cloudy appearance due to the fact that water solubility decreases with decreasing temperature. The purpose of the steam stripping step is for the distillate fuel oil to meet a flash point temperature specification. The purchaser's specifications require that the distillate fuel oil be bright and clear in appearance.

A number of alternative methods are known and have been used to reduce the moisture content of the fuel oil product. For example, one process requires reboiling the distillate fuel while avoiding any contact with steam. Other methods use sand or filter cartridge coalescers to facilitate separation of the water droplets from the fuel oil. The product is then stored for a period of time until its appearance clears. In some cases, air is blown or bubbled through the storage tank to reduce the storage time but this step can be hazardous. Another process employs electrostatic precipitators but these devices are expensive both to install and to operate. The use of clay dessicant towers is also an expensive operation. One common technique involves the use of a salt-filled tower downstream of a coalescer. However, discharge of the salt water results in unacceptable water pollution or requires expensive water treatment while the cost of salt and the maintenance of the tower is also relatively high.

The present invention avoids the foregoing disadvantages by providing a distillate fuel oil de-watering process that is substantially less expensive to both install and operate than has been the case and which will produce a clear and bright finished fuel oil.

Normally, the water saturated fuel leaves a steam stripper in the final stage of the refining process at a temperature of between 400°-600° F. As the distillate is cooled to storage temperatures, solubility of the water in the fuel oil decreases and takes on the appearance of a haze due to the very fine minute droplets of water forming in the distillate oil. After cooling in the refinery process to recover the heat in the distillate fuel oil, the fuel oil is ready for treatment by the method of the present invention. Specifically, with the temperature reduced to about 120°-180° F., the fuel oil laden with moisture is passed through a first heat exchanger where the incoming oil is cooled by the de-watered outcoming oil being treated by the process. From the first heat exchanger, the incoming oil is passed through one or more secondary heat exchangers which may be cooled by water or air so that the oil passed through the second heat exchanger has its temperature reduced to about 80°-100° F. From the second heat exchanger, the cooled oil is passed through a sand coalescing vessel which is designed to effectively separate the water droplets from the fuel oil. From the sand coalescer, the recovered oil, as noted above, is passed back through the first heat exchanger to raise its temperature to a range of between 100°-120° F. before sending the fuel oil to storage. Water from the sand coalescer vessel is discharged to drain.

It will be appreciated that the process can be run, after installation, with only the minor additional cost of supplying a cooling fluid to the second heat exchanger device and periodic cleaning or replacement of the sand in the sand coalescer vessel.

Additional advantages will become apparent as consideration is given to the following detailed description taken in conjunction with the accompanying drawings, in which:

DETAILED DESCRIPTION OF THE INVENTION

Figure 1:
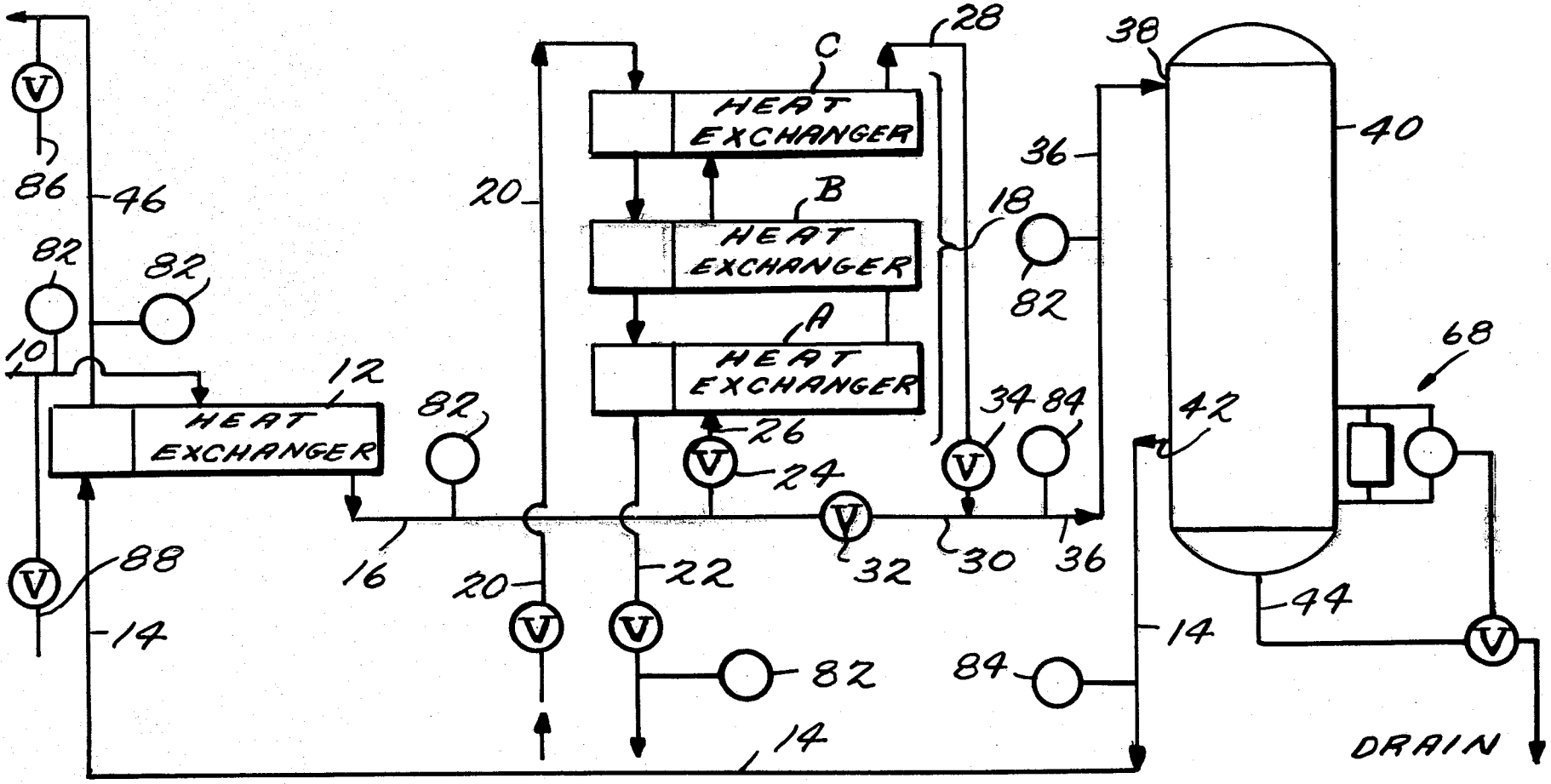
FIG. 1 is a schematic flow chart of the process of the present invention.

Referring now to the drawings wherein the numerals designate corresponding parts throughout the views, there is shown in FIG. 1 a schematic diagram illustrating the process of the present invention.

The incoming distillate fuel oil will originate from any number of different refinery processes, for example, a crude unit fractionator, a catalytic cracker fractionator, a hydrocracking unit fractionator or a distillate fuel oil desulphurizer unit. In each case, the final step in the process is to steam strip the distillate fuel oil in order to meet a flash point temperature specification. The heat imparted to the fuel oil by the steam stripper is normally recovered for re-use in the refining process so that the oil is cooled to approximately 120°-180° F. in the normal refining process before being passed to storage or the conventional dehazing processes presently in use.

According to the present invention, the thus cooled and highly water saturated fuel oil is passed through a conduit 10 to a first heat exchanger 12 where the incoming water laden fuel oil has its temperature reduced by approximately 20° F. by a cooling fluid introduced through conduit 14. According to the present invention, the fluid passing through the conduit 14 to the heat exchanger 12 is preferably the cooled oil that has already been passed through the process of the present invention, whereby contact in heat exchanging relation with the incoming fuel oil raises its temperature, as will be explained hereinafter.

From the heat exchanger 12, the fuel oil now cooled to a temperature of between 100° and 160° F. is passed through a conduit 16 to a second heat exchanging system 18. In the illustrated embodiment, the heat exchange system 18 may comprise three stages A, B and C and the cooling fluid may be water or air which is introduced through conduit 20 to the last stage C of the system 18 and then sequentially through stages B and A from which the cooling water is returned to a conditioning unit (not shown) through conduit 22. The fuel oil is passed through valve 24 in conduit 26 in the opposite direction (counterflow), that is, from stage A, then through B and C, from which the oil leaves the system 18 through conduit 28 after it has been cooled to a temperature within the range of 80°-100° F. With this arrangement, it will be appreciated that the oil is not subjected to an abrupt temperature change since the cooling fluid passing through conduit 20 through stages C, B and A will be gradually elevated in temperature so that the cooling fluid's temperature at stage A will be higher than at stage C, while the temperature of the fuel oil entering stage A will be at its maximum and will fall as it proceeds through stages A, B and then C.

A bypass conduit 30 having a normally closed bypass valve 32 may be employed to take care of cases where upstream conditions require bypassing system 18 such as, for example, where the inlet temperature of the cooling water would vary seasonally.

The conduit 28 passes the now cooled distillate oil through a valve 34 to conduit 36 which, in turn, introduces the cooled distillate fuel oil to the inlet 38 of a sand coalescer vessel 40, the structure and function of which will be described in connection with FIG. 2. In brief, however, the sand coalescer vessel 40 functions to separate the oil and water droplets so that the oil can be taken off at the oil outlet 42 and passed to conduit 14. At the outlet 42, the oil is at a temperature of approximately 80°–100° F. before being passed back through heat exchanger 12 where the now de-watered oil has its temperature raised approximately 20° F. From heat exchanger 12, the dewatered oil is passed through conduit 46 to a storage tank. The oil at this point is bright and clear in appearance.

Figure 2:
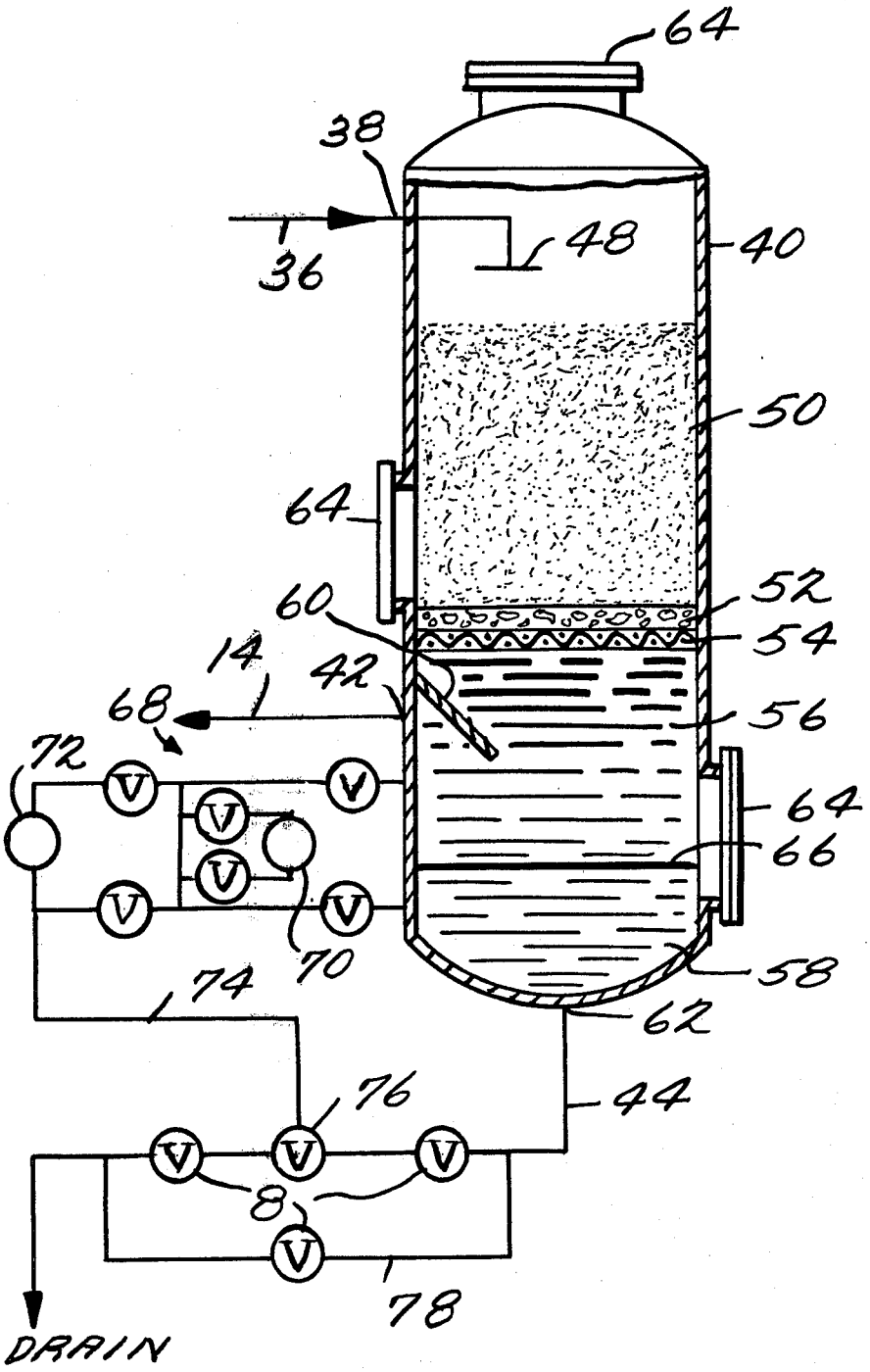
FIG. 2 is a sectional view in elevation of the sand coalescer vessel of the present invention.

Turning now to FIG. 2, there is shown a sectional view in elevation of the sand coalescer vessel 40. The vessel 40 is preferably cylindrical in cross-section having its longitudinal axis extending vertically so that flow from the oil inlet 38 will proceed downwardly through the vessel. The conduit 36 will proceed through the inlet 38 to distribute the oil over a baffle plate 48 which spreads the oil over the surface of a column of sand 50. The sand is preferably sharp edged flint sand such as that sold by the F & S Abrasives Company, Inc. of Alabama under the designation No. 4 Flintbrasive. Below the sand bed 50 should be placed a coarse gravel bed 52 which is supported by a 20-mesh screen 54. With this arrangement, the oil will accumulate in the area 56 while the water will accumulate below the oil as at 58. A 45° angle baffle plate will be disposed above the outlet 42 for the oil while the water drain pipe 44 will be located at the lowest point where a water outlet is provided at 62. The vessel 40 should be provided with at least three manholes 64 to facilitate entry by workmen to clean and service the interior of the vessel 40.

As the cooled distillate fuel enters the coalescer 40 through the inlet 38, it flows downwardly where the minute water particles coalesce and grow into larger droplets on the sand. The water droplets finally settle to the water phase at the bottom of the coalescer vessel 40 with the oil floating atop the water phase at 56. The water level, indicated by the dark line 66, should be controlled by a water level detection system indicated at 68. The control system 68 may utilize a gauge glass 70 which is connected through suitable conduits and valves to both the oil and water portions collected in the bottom of the vessel 40. The water level device actuates a level control element 72 which in turn acts through a pneumatic line 74 to control a normally closed dump valve 76. In some operations, of course, a bypass of this system as through conduit 78 and control valves 80 may be employed.

Referring back to FIG. 1, it will be apparent that the system readily lends itself to monitoring and control such as by employing temperature sensors as indicated at 82 throughout the system at strategic locations and pressure sensors such as at 84 to monitor the flow rate and operation of the sand coalescer vessel. For example, where the pressure drop between the pressure gauge or sensor in line 36 and line 14 indicate an increase in the pressure drop through the vessel 40, the operators may then stop the flow into the vessel 40 and drain the vessel so that 12–18 inches of the top of the sand bed 50 can then be skimmed off and replaced with clean sand.

Visual and chemical testing of the incoming and treated distillate fuel oil can be easily obtained as through conduits 86 and 88, respectively.

EXAMPLE

A No. 2 fuel oil distillate is drawn off from a crude oil fractionator and then was steam stripped at 490° F. at 60 psig in order to meet a minimum flash temperature specification of 150° F. The distillate oil at a rate of 3200 barrels per day was pumped through a series of heat exchangers where the temperature was reduced to about 145° F. The fuel oil at 145° F. contained free water as minute droplets in the form of a moisture haze and was fed to one side of the heat exchanger 12 where the temperature was dropped by approximately 20° F. to about 125° F. The already cool outgoing de-watered fuel oil was passed through conduit 14 to heat exchanger 12 and had its temperature raised from 85° F. to 105° F. and then was passed to a fuel oil storage tank. The incoming fuel oil was passed from the heat exchanger 12 through heat exchange system 18 where water was used as the cooling medium. The temperature of the distillate fuel oil was further reduced from 125° F. to 85° F. The still moisture and haze laden distillate was supplied to the top of a 6-ft. diameter sand coalescer vessel 40. At the input rate of 3200 barrels per day, the amount of water recovered was 375 gallons per day on the average. The fuel oil going to storage was found to be crystal clear and without haze at the 125° F. temperature to storage and showed no water by a centrifuging process. Further, the fuel oil in the tank remained clear and without moisture haze at temperatures as low as 65° F.

At the feed rate of 3200 barrels per day, the pressure dropped through the vessel 40 averaged 8 psi.

Having described the invention, it will be apparent that various modifications may be made therein without departing from the spirit and scope of the invention as defined in the appended claims.

What is claimed is:

1. A method of reducing the water content in liquid hydrocarbon distillate fuel oil that has been subjected to a steam treatment, and subsequently cooled prior to being sent to storage to about 120°–180° F., comprising the steps of:

(A) gradually cooling the fuel oil by (a) passing the oil to a first indirect cooling means to reduce the temperature of the oil by approximately 20° F.;

(b) passing the oil to a second indirect cooling means to further reduce the temperature of the oil;

(B) passing the oil from the second cooling means to and through separation means where at least a substantial portion of the water is separated from the oil;

(C) heating the oil collected from said separation means prior to storage.

2. The method as claimed in claim 1 wherein said first and second cooling means are first and second heat exchange devices, respectively, and the step of heating the oil comprises passing the oil from said separating means through said first heat exchange device.

3. The method as claimed in claims 1 or 2 including the step of supplying a cooling fluid to said second cooling means to effect cooling of the oil passed through said second cooling means.

4. The method as claimed in claims 1 or 2 wherein the separation means is a vessel having an inlet means at one end thereof and a first and second outlet means adjacent the other end thereof with said first outlet means being located vertically above the second outlet means relative to said other end of said vessel so that oil will pass through said first outlet means and water will pass through said second outlet means, and a coalescing medium is disposed between said inlet means and said first outlet means to effect separation of the oil and water, the method including the step of passing the oil from said inlet means vertically downwardly through said coalescing medium.

5. The method of claim 4 wherein the coalescing medium is sand.

6. The method of claim 1 including the step of cooling the oil at the second cooling means to a temperature within the range of approximately 80° F. to 100° F.

7. The method of claim 1 including the step of heating the de-watered oil passed from the separating means to a temperature approximately 20° F. higher than the temperature of the oil leaving the separation means before passing the oil to storage means.

8. The method of claim 7 including the step of heating the de-watered oil passed from the separating means by passing the de-watered oil through said first cooling means.

* * * * *